US010747180B2

(12) United States Patent
Ichimura

(10) Patent No.: US 10,747,180 B2
(45) Date of Patent: Aug. 18, 2020

(54) CASE AND TIMEPIECE

(71) Applicant: CASIO COMPUTER CO., LTD., Tokyo (JP)

(72) Inventor: Tatsumi Ichimura, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 215 days.

(21) Appl. No.: 15/949,162

(22) Filed: Apr. 10, 2018

(65) Prior Publication Data

US 2018/0292789 A1 Oct. 11, 2018

(30) Foreign Application Priority Data

Apr. 10, 2017 (JP) ..... 2017-077571

(51) Int. Cl.

| | |
|---|---|
| ***G04B 37/22*** | (2006.01) |
| ***G04B 43/00*** | (2006.01) |
| ***G04G 17/08*** | (2006.01) |
| ***G04C 3/00*** | (2006.01) |

(52) U.S. Cl.

CPC ..... *G04B 37/225* (2013.01); *G04B 43/002* (2013.01); *G04C 3/001* (2013.01); *G04G 17/08* (2013.01)

(58) Field of Classification Search

CPC .. G04B 37/225; G04B 43/002; G04B 37/005; G04B 37/055; G04B 37/221; G04C 3/001; G04G 17/08

USPC ..... 368/280, 88, 281, 287, 291, 294, 300

See application file for complete search history.

(56) References Cited

U.S. PATENT DOCUMENTS

| | | | | |
|---|---|---|---|---|
| 6,310,835 | B1 | 10/2001 | Mantoan et al. | |
| 6,762,976 | B1 | 7/2004 | Tamaru et al. | |
| 8,636,404 | B2 * | 1/2014 | Hiranuma | G03F 7/029 368/287 |
| 8,708,552 | B2 * | 4/2014 | Ueno | G04G 17/08 368/276 |
| 8,773,847 | B2 * | 7/2014 | Byun | H04B 1/385 361/679.03 |

(Continued)

FOREIGN PATENT DOCUMENTS

| | | |
|---|---|---|
| CN | 205644047 U | 10/2016 |
| EP | 1 098 233 B1 | 2/2009 |
| JP | S48-030218 Y1 | 9/1973 |

(Continued)

OTHER PUBLICATIONS

Notification of Reasons for Refusal dated Mar. 5, 2019 received in Japanese Patent Application No. JP 2017-077571 together with an English language translation.

(Continued)

*Primary Examiner* — Edwin A Leon

(74) *Attorney, Agent, or Firm* — Scully Scott Murphy & Presser

(57) ABSTRACT

A case includes a case main body, an exterior cover formed of a synthetic resin and mounted on an upper portion and an outer circumferential portion of the case main body to cover the upper portion and the outer circumferential portion, and a reinforcement member formed of a synthetic resin harder than the exterior cover and embedded in an inner surface of the exterior cover to prevent an inner circumferential side of the exterior cover from being bent back relative to the case main body.

15 Claims, 9 Drawing Sheets

(56) References Cited

U.S. PATENT DOCUMENTS

2016/0062316 A1 3/2016 Maruyama

FOREIGN PATENT DOCUMENTS

| | | | |
|---|---|---|---|
| JP | S55-063780 | A | 5/1980 |
| JP | H06-017110 | Y2 | 5/1994 |
| JP | 2000-329869 | A | 11/2000 |
| JP | 5967156 | B2 | 7/2016 |

OTHER PUBLICATIONS

Examination Report dated Apr. 23, 2020 received in Indian Patent Application No. IN 201814013527 together with an English language translation.

* cited by examiner

CASE AND TIMEPIECE

CROSS-REFERENCE TO RELATED APPLICATION

This application claims priority from Japanese Patent Application No. 2017-077571 filed on Apr. 10, 2017, the entire subject matter of which is incorporated herein by reference.

BACKGROUND OF THE INVENTION

The present invention relates to a case used for electronic devices, such as wrist timepieces, mobile phones and mobile information terminals, and to a timepiece having the same.

For example, as wrist timepiece cases, as disclosed in Japanese Patent Application Publication No. 2000-329869, a case is known, in which an exterior cover made of soft synthetic resin is provided on an outer circumference of an upper portion of a case main body made of metal and a pressing member made of metal is arranged on the exterior cover, so that the exterior cover is fixed to the case main body by the pressing member.

In this type of wrist timepiece case, the pressing member made of metal is attached to the case main body by a plurality of screws, so that the exterior cover is pressed against the case main body by the pressing member, thereby preventing the exterior cover made of soft synthetic resin from being bent back relative to the case main body.

However, in such a wrist timepiece case, it is necessary to press the exterior cover against the case main body using the pressing member made of metal, in order to attach the exterior cover in such a manner that the exterior cover made of soft synthetic resin is prevented from being bent back relative to the case main body. As a result, the number of components as additional components is increased.

SUMMARY OF THE INVENTION

The present invention is directed to a case and a timepiece having the case, in which it is possible to prevent an exterior cover from being bent back relative to a case main body without using additional components.

One aspect of the present invention is a case including a case main body; an exterior cover formed of a synthetic resin and mounted on an upper portion and an outer circumferential portion of the case main body to cover the upper portion and the outer circumferential portion; and a reinforcement member formed of a synthetic resin harder than the exterior cover and embedded in an inner surface of the exterior cover to prevent an inner circumferential side of the exterior cover from being bent back relative to the case main body.

DESCRIPTION OF THE PREFERRED EMBODIMENT

First Embodiment

Hereinafter, a first embodiment, in which the present invention is applied to a wrist timepiece, will be described with reference to FIGS. 1 to 5A and 5B.

As shown in FIGS. 1 to 4, the wrist timepiece has a wrist timepiece case 1. The wrist timepiece case 1 is constituted of a case main body 2 and an exterior cover 3.

As shown in FIGS. 1 to 4, a timepiece glass 4 is attached on an upper opening portion of the wrist timepiece case 1, i.e., an upper opening portion of the case main body 2 via a glass packing 4*a*. A back cover (not shown) is attached on a lower portion of the wrist timepiece case 1, i.e., a lower portion of the case main body 2. Also, a timepiece module (not shown) is provided in the inside of the wrist timepiece case 1, i.e., the inside of the case main body 2.

Figure 1:
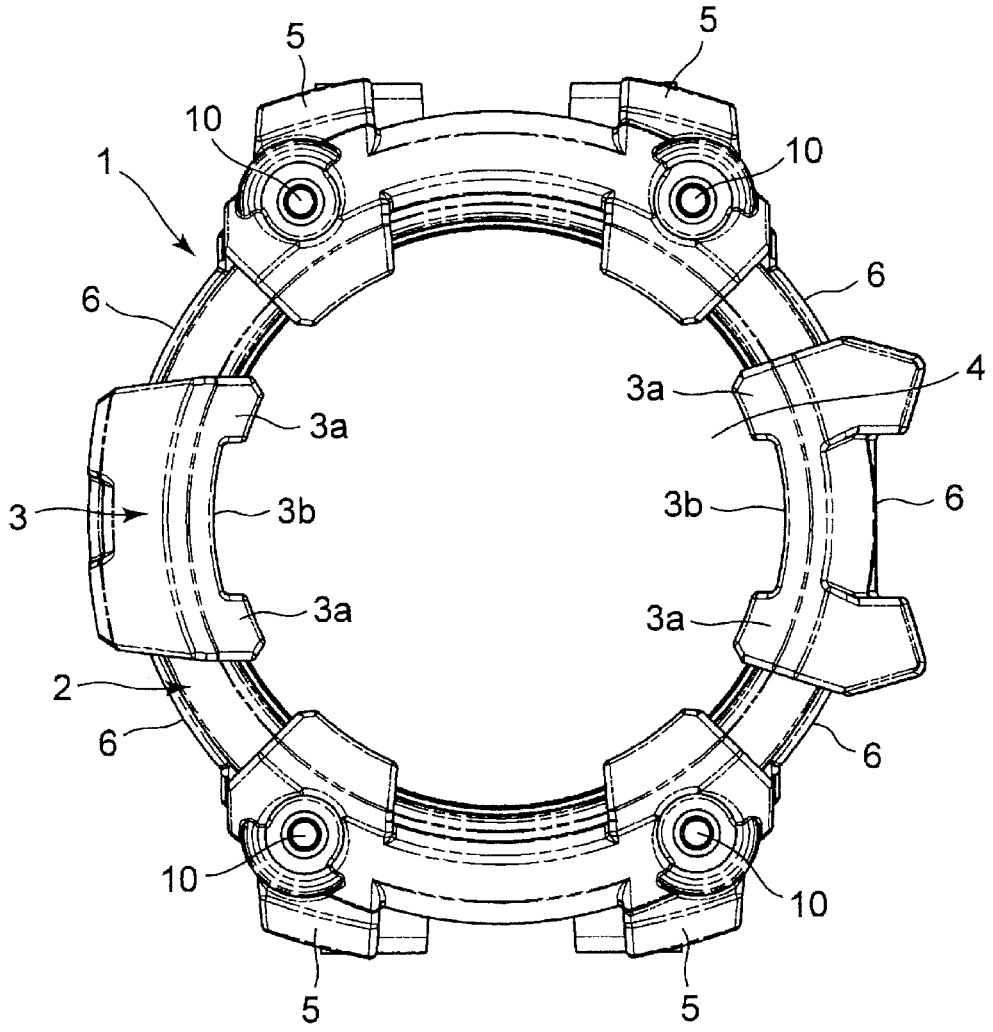
FIG. 1 is an enlarged front view showing a first embodiment in which the present invention is applied to a wrist timepiece.

As shown in FIG. 1, band attaching portions 5, to which a timepiece band (not shown) is to be attached, are respectively provided on 12 and 6 o'clock sides of the wrist timepiece case 1. Also, switch portions 6 are respectively provided on 2, 3, 4, 8 and 10 o'clock sides of the wrist timepiece case 1.

Figure 3:
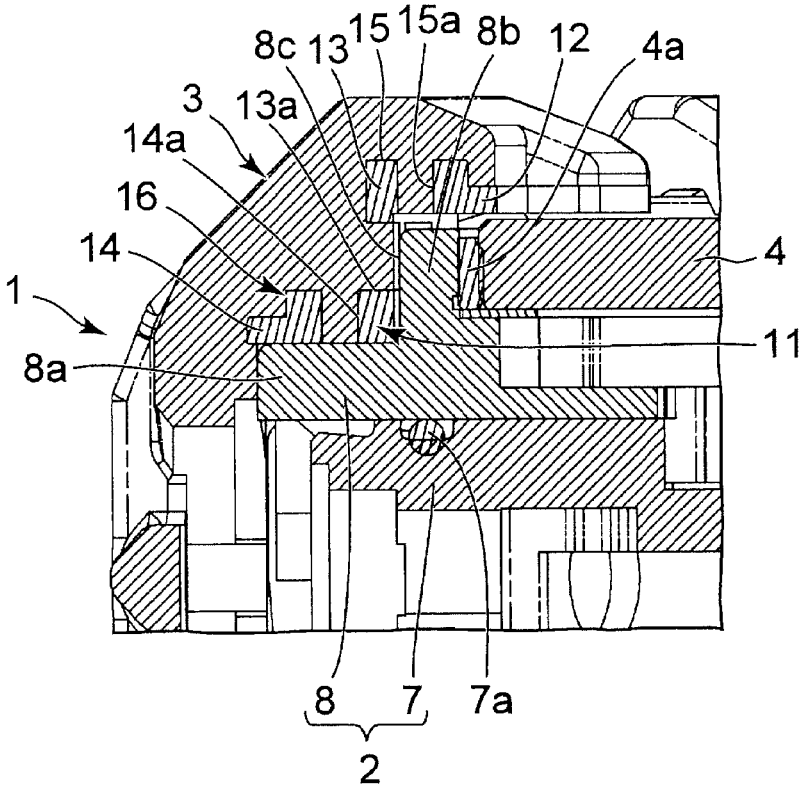
FIG. 3 is an enlarged sectional view showing a main part of a wrist timepiece case shown in FIG. 2 as viewed in a direction of an A-A arrow.
Figure 4:
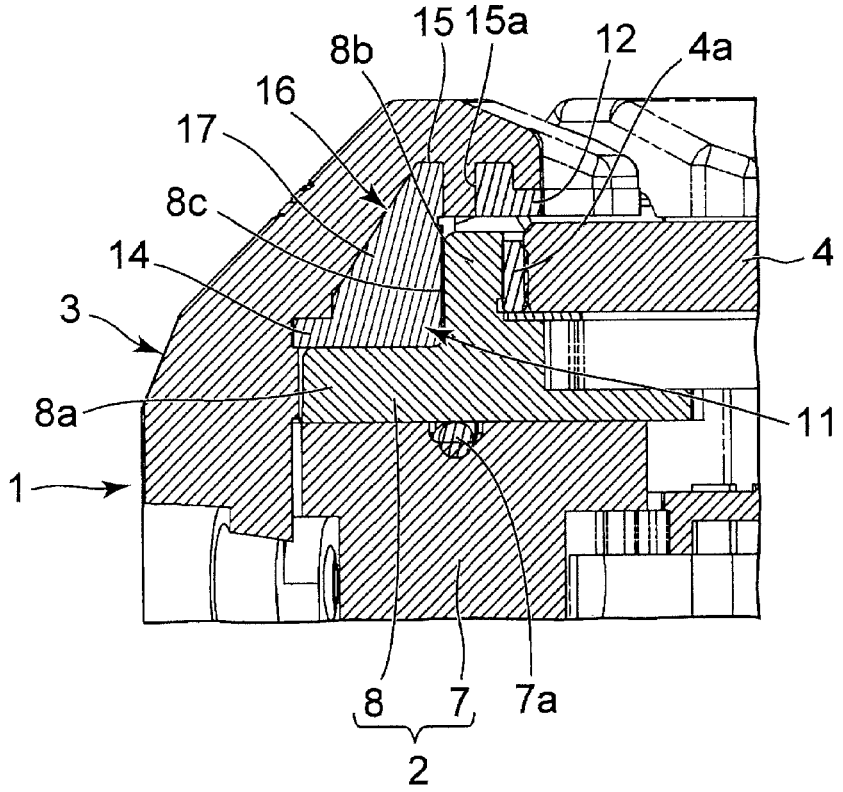
FIG. 4 is an enlarged sectional view showing the main part of the wrist timepiece case shown in FIG. 2 as viewed in a direction of a B-B arrow.

Meanwhile, as shown in FIGS. 3 and 4, the case main body 2 of the wrist timepiece case 1 is constituted of a first case portion 7 and a second case portion 8. The first case portion 7 is generally formed in a barrel shape using a metal, such stainless steel, or a hard synthetic resin. The first case portion 7 is configured such that the timepiece module (not shown) is arranged therein and a plurality of switch portions 6 (see FIG. 1) is attached on an outer circumferential portion thereof.

As shown in FIGS. 3 and 4, the second case portion 8 is generally formed in a ring shape using a metal, such as stainless steel, and is attached on an upper portion of the first case portion 7 via a waterproof ring 7*a*. That is, the second case portion 8 has a ring-shaped base portion 8*a* configured to be attached on the upper portion of the first case portion 7, and a ring-shaped wall portion 8*b* erected on the base portion 8*a*.

Thus, as shown in FIGS. 3 and 4, the second case portion 8 has notch portions formed on inner and outer circumferential sides, respectively, of the wall portion 8*b*. Therefore, the second case portion 8 is configured such that the timepiece glass 4 is attached on an inner circumferential surface of the notch portion located on the inner circumferential side of the wall portion 8*b* via the glass packing 4*a*, and a part of an inner surface of the exterior cover 3 as described below is arranged in the notch portion located on the outer circumferential side of the wall portion 8*b*.

Meanwhile, as shown in FIGS. 1 to 4, the exterior cover 3 is formed by a soft synthetic resin, such as polyurethane, and is configured to be attached on the upper portion and the outer circumferential portion of the case main body 2 to cover them. That is, the exterior cover 3 is configured to cover a region extending from the upper portion and the outer circumferential portion of the second case portion 8 of the case main body 2 to an outer circumferential portion of the first case portion 7. Also, in this state, the exterior cover 3 is configured to be attached to the second case portion 8 by a plurality of screws 10 at locations thereon located on both sides of each of the band attaching portions 5.

Further, as shown in FIG. 1, the exterior cover 3 is formed such that parts thereof, which are located on both sides of each of the band attaching portions 5 and to which the plurality of screws 10 are respectively attached, a part thereof located on a 3 o'clock side and a part thereof located on a 9 o'clock side protrude toward inner and outer circumferential sides thereof. Thus, as shown in FIGS. 2 to 4, the exterior cover 3 is configured such that parts thereof protruding toward the inner circumferential side are arranged over a region extending from an edge portion of the timepiece glass 4, which is located on an outer circumference thereof, to an upper surface of the timepiece glass 4.

Figure 2:
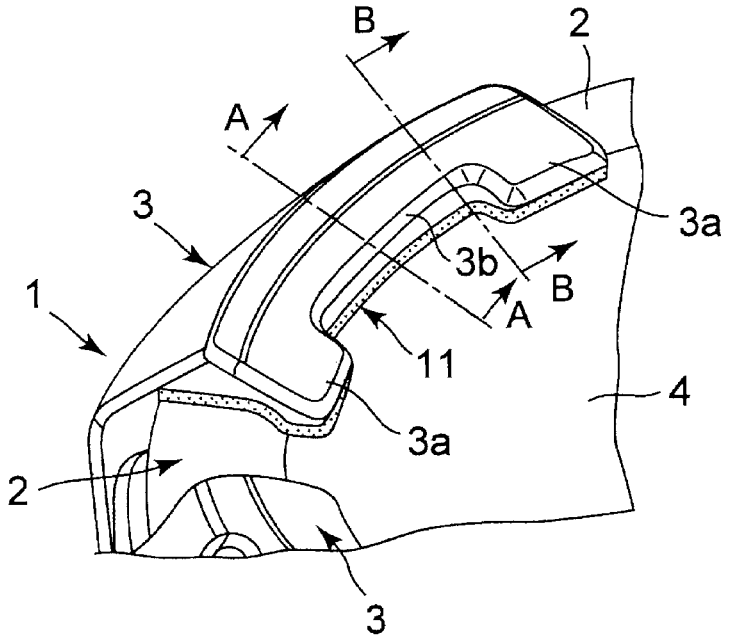
FIG. 2 is an enlarged perspective view showing a main part of a 9 o'clock side of the wrist timepiece shown in FIG. 1.

In this case, as shown in FIGS. 1 and 2, the parts of the exterior cover 3 located on the 3 and 9 o'clock sides are formed such that radial lengths thereof are longer than radial lengths of the parts thereof on both sides of each of the band attaching portions 5. Also, a notch portion 3*b* is provided in an inner circumferential portion of each of the parts of the exterior cover 3 located on the 3 and 9 o'clock sides, except both side portions 3*a* thereof in the radial direction.

Since the parts of the exterior cover 3 located on both sides of each of the band attaching portions 5 are fixed by the screws 10 as shown in FIGS. 1 and 2, the exterior cover 3 is attached such that inner circumferential portions of the parts located on both sides of each of the band attaching portions 5 are prevented from being bent back relative to the timepiece glass 4. Also, the exterior cover 3 is configured such that the inner circumferential portions of the parts located on the 3 and 9 o'clock sides tend to be bent back relative to the timepiece glass 4.

Therefore, as shown in FIGS. 3 to 5A and 5B, the exterior cover 3 has reinforcement members 11 respectively embedded in inner circumferential surfaces of the parts located on the 3 and 9 o'clock sides in order to prevent the inner circumferential portions thereof from being bent back. That is, each of the reinforcement members 11 is integrally formed with the exterior cover 3 using a synthetic resin, such as polyamide or polycarbonate, harder and more rigid than the exterior cover 3. Further, each reinforcement member 11 includes first to third reinforcing portions 12 to 14.

As shown in FIGS. 3 to 5A and 5B, the first reinforcing portion 12 is an upper horizontal plate portion and is arranged on a lower surface of the exterior cover 3, which is located on the inner circumferential portion thereof. Therefore, the first reinforcing portion 12 is configured to correspond to an upper end portion of the wall portion 8*b* of the second case portion 8 of the case main body 2 and the outer circumferential portion of the timepiece glass 4. Also, the first reinforcing portion 12 is formed such that an inner circumferential portion thereof has the same shape as that of the inner circumferential portion of the exterior cover 3.

That is, as shown in FIGS. 2 to 5A and 5B, the first reinforcing portion 12 is formed such that the inner circumferential portion thereof has a shape corresponding to both side portions 3*a*, in the radial direction, of the inner circumferential portion of the exterior cover 3 and the notch portion 3*b* provided therebetween. Thus, the first reinforcing portion 12 is configured such that edge portions of the inner circumferential portion and also of both side portions thereof are exposed to the outside on the inner circumferential side of the exterior cover 3. Also, the first reinforcing portion 12 is provide with a plurality of first circular biting holes 12*a* arranged at predetermined intervals along the radial direction (length direction) and configured to allow the exterior cover 3 to bite and be fixed thereto.

As shown in FIGS. 3 to 5A and 5B, the second reinforcing portion 13 is a vertical plate portion and is arranged on an inner surface of the exterior cover 3. Therefore, the second reinforcing portion 13 is configured to correspond to an outer circumferential surface 8*c* of the wall portion 8*b* of the second case portion 8 of the case main body 2. The second reinforcing portion 13 is integrally formed with the first reinforcing portion 12 to extend from an outer circumferential end portion of the first reinforcing portion 12 to an upper surface of the base portion 8*a* along the outer circumferential surface 8*a* of the wall portion 8*b* of the second case portion 8. The second reinforcing portion is provide with a plurality of second quadrilateral biting holes 13*a* arranged at predetermined intervals along the radial direction and configured to allow the exterior cover 3 to bite and be fixed thereto.

As shown in FIGS. 3 to 5A and 5B, the third reinforcing portion 14 is a lower horizontal plate portion and is arranged on a lower surface of the exterior cover 3, which is located on the outer circumferential side thereof. Therefore, the third reinforcing portion 14 is configured to correspond to an upper surface of the base portion 8*a* of the second case portion 8 of the case main body 2, which is located on the notch portion provided on the outer circumferential side of the wall portion 8*b* thereof.

That is, as shown in FIGS. 3 to 5A and 5B, the third reinforcing portion 14 is integrally formed with the second reinforcing portion 13 to extend from a lower end portion of the second reinforcing portion 13 to an outer circumferential end portion of the base portion 8*a* of the second case portion 8, which is located on the notch portion provided on the outer circumferential side of the wall portion 8*b* thereof. The third reinforcing portion 14 is provide with a plurality of third circular biting holes 14*a* arranged at predetermined intervals along the radial direction and configured to allow the exterior cover 3 to bite and be fixed thereto.

Also, as shown in FIGS. 3 to 5A and 5B, the reinforcement member 11 has a shock releasing portion 15 for releasing a shock from the outside. The shock releasing portion 15 is a plate-shaped portion elongated in the radial direction and is located on and integrally formed with an upper end portion of the second reinforcing portion 13 to protrude upward from an upper surface of the first reinforcing portion 12.

As shown in FIGS. 3 to 5A and 5B, the shock releasing portion 15 is also provided with a plurality of fourth circular biting holes 15*a* arranged at predetermined intervals along the radial direction and configured to allow the exterior cover 3 to bite and be fixed thereto. Thus, the shock releasing portion 15 is configured such that when a shock is exerted on the exterior cover 3 from above, the shock is dispersed and released to the inner and outer circumferential sides of the exterior cover 3 and also the shock is absorbed by the plurality of fourth biting holes 15*a*.

In addition, as shown in FIGS. 3 to 5A and 5B, the reinforcement member 11 has a defamation restriction portion 16 for restricting deformation of the first to third reinforcing portions 12 to 14 and the shock releasing portion 15. The defamation restriction portion 16 includes the third reinforcing portion 14, which is a first restricting portion, and a plurality of second restricting portions 17. The third reinforcing portion 14, which is the first restricting portion, is a lower horizontal plate portion and is arranged on the lower surface of the exterior cover 3, which is located on the outer circumferential side thereof. Therefore, the third reinforcing portion 14 is configured to correspond to the upper surface of the base portion 8*a* of the second case portion 8 of the case main body 2, which is located on the notch portion provided on the outer circumferential side of the wall portion 8*b* thereof.

Figure 5A:
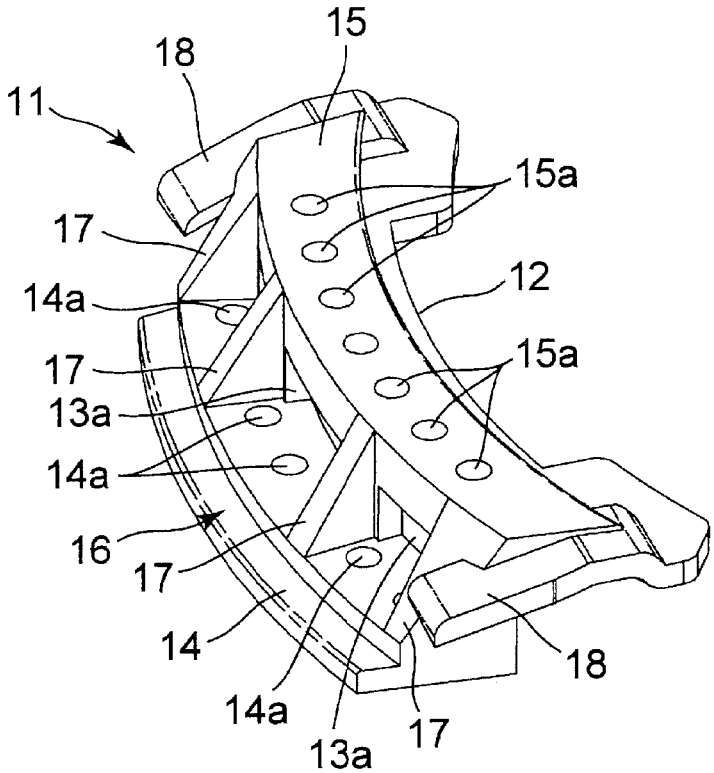
FIG. 5A is an enlarged perspective view showing a reinforcement member of the wrist timepiece case shown in FIG. 3 as viewed from above.
Figure 5B:
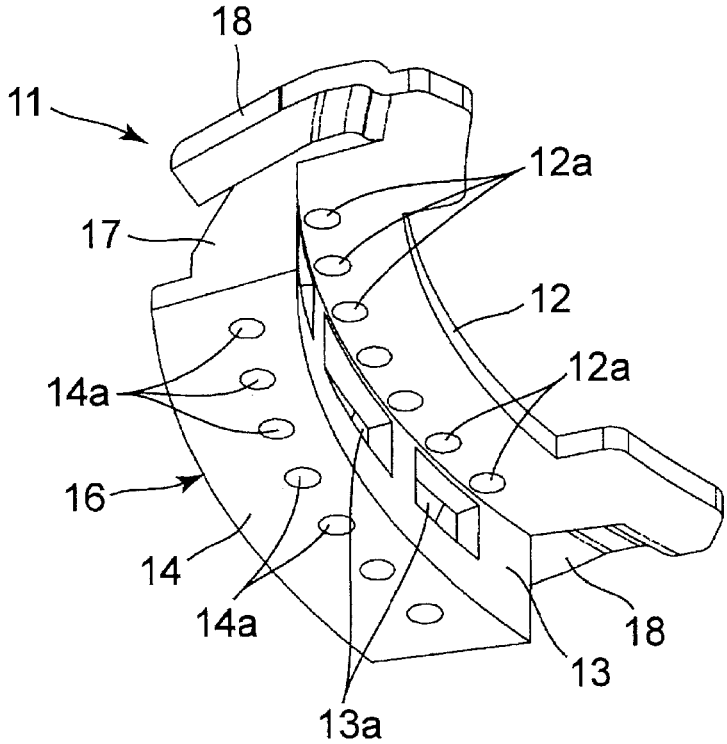
FIG. 5B is an enlarged perspective view showing the reinforcement member of the wrist timepiece case shown in FIG. 3 as viewed from below.

As shown in FIGS. 4, 5A and 5B, the plurality of second restricting portions 17 are triangular beam portions bridged between an outer circumferential surface of the second reinforcing portion 13 and an upper surface of the third reinforcing portion 14, which is the first restricting portion, and are integrally formed with the second reinforcing portion 13 and the third reinforcing portion 14. That is, the plurality of second restricting portions 17 are provided on both side portions of the second reinforcing portion 13 and the third reinforcing portion 14 in the radial direction and also at locations, which are located between the side portions and also between the plurality of third biting holes 14*a* of the third reinforcing portion 14, and thus are configured to restrict deformation of the second reinforcing portion 13 and the third reinforcing portion 14 relative to each other.

Also, on both side portions of the reinforcement member 11 in the radial direction (length direction), decorative portions 18 are respectively integrally formed therewith as shown in FIGS. 2, 5A and 5B. The decorative portions 18 are collar-shaped portion extending from both side portions, in the length direction, of the first reinforcing portion 12 to the second restricting portions 17 by way of both side portions, in the length direction, of the second reinforcing portion 13. Like the first reinforcing portion 12, the decorative portions 18 are configured such that edge portions of both side portions thereof are exposed to the outside of the exterior cover 3.

In this case, the reinforcement member 11 may have the same color as that of the exterior cover 3, but preferably has a color different from that of the exterior cover 3 as shown in FIG. 2. Thus, since edge portions of the inner circumferential portion of the first reinforcing portion 12 and also of both side portions of the decorative portions 18 are exposed to the outside of the exterior cover 3 with a color different from that of the exterior cover 3, the reinforcement member 11 is configured to become an accent on design.

Next, the effects of the wrist timepiece case 1 will be described.

The exterior cover 3 and the reinforcement member 11 of the wrist timepiece case 1 are integrally formed with each other by two-color molding. Therefore, when the exterior cover 3 and the reinforcement member 11 are formed by two-color molding, the reinforcement member 11 is first molded by a first mold.

In this case, the first mold includes an upper die and a lower die. The reinforcement member 11 is molded using the upper die and the lower die. Then, when the upper die and the lower die are separated from each other, only the upper die is separated and removed with the molded reinforcement member 11 left in the lower die. Thereafter, the exterior cover 3 is molded using a second mold.

When the exterior cover 3 is molded using the second mold, an upper die of the second mold is superimposed on the lower die of the first mold, in which the reinforcement member 11 is left, and in this state, the exterior cover 3 is molded. Thus, the reinforcement member 11 and the exterior cover 3 are integrally formed with each other in a state where the reinforcement member 11 is embedded in the inner circumferential surface of the exterior cover 3. At this time, the exterior cover 3 is formed to bite into the first to fourth biting holes 12*a* to 15*a* provided in the reinforcement member 11.

When the exterior cover 3 with the reinforcement member 11 integrally formed as described above is attached to the case main body 2, the exterior cover 3 is mounted on a region extending from the upper portion and the outer circumferential portion of the second case portion 8 of the case main body 2 to the outer circumferential portion of the first case portion 7. In this state, the parts of the exterior cover 3 located on both side portions of each of the band attaching portions 5 are attached to the second case portion 8 by the plurality of screws 10. As a result, the wrist timepiece case 1 is assembled.

According to the wrist timepiece case 1 assembled as described above, the first reinforcing portion 12 of the reinforcement member 11 embedded in the exterior cover 3 is arranged to correspond to the upper end portion of the wall portion 8*b* of the second case portion 8, and the second reinforcing portion 13 is arranged to correspond to the outer circumferential surface 8*c* of the wall portion 8*b* of the second case portion 8. Also, the third reinforcing portion 14, which also serves as the first restricting portion of the defamation restriction portion 16, is arranged to correspond to the upper surface of the base portion 8*a* of the second case portion 8, which is located on the outer circumferential side of the wall portion 8*b* thereof.

At this time, the edge portions of the inner circumferential portion of the first reinforcing portion 12 and also of both side portions of the decorative portions 18 in the reinforcement member 11 are arranged to be exposed to the outside of the exterior cover 3. Therefore, by forming the reinforcement member 11 to have a color different from that of the exterior cover 3, the edge portions of the inner circumferential portion of the first reinforcing portion 12 and also of both side portions of the decorative portions 18 are exposed to the outside of the exterior cover 3 with a color different from that of the exterior cover 3. Thus, the reinforcement member 11 becomes an accent on design, thereby enhancing designability.

In this state, when an external force causing the inner circumferential portion of the exterior cover 3 of the wrist timepiece case 1 to be bent back is exerted thereon, the reinforcement member 11 prevents the inner circumferential portion of the exterior cover 3 from being bent back, since the reinforcement member 11 is integrally formed with the exterior cover 3 using a synthetic resin, such as polyamide or polycarbonate, having a higher rigidity and also the exterior cover 3 bites and is fixed to the first to fourth biting holes 12*a* to 15*a* provided in the reinforcement member 11.

That is, if an external force causing the inner circumferential portion of the exterior cover 3 to be bent back is exerted thereon, the inner circumferential portion of the first reinforcing portion 12 of the reinforcement member 11 is going to be pushed up due to the external force, but the second reinforcing portion 13 abuts against the outer circumferential surface 8*c* of the wall portion 8*b* of the second case portion 8 so that the first reinforcing portion 12 is prevented from being pushed up. Therefore, the inner circumferential portion of the exterior cover 3 is not bent back.

Also, at this time, deformation of the first reinforcing portion 12 and the second reinforcing portion 13 can be prevented by the deformation restriction portion 16. That is, in the defamation restriction portion 16, the third reinforcing portion 14, which is the first restricting portion, abuts against the upper surface of the base portion 8*a* of the second case portion 8, which is located on the notch portion on the outer circumferential side thereof, and the plurality of second restricting portions 17 are bridged between the third reinforcing portion 14, which is the first restricting portion, and the second reinforcing portion 13.

Therefore, in the state where the second reinforcing portion 13 abuts against the outer circumferential surface 8*c* of the wall portion 8*b* of the second case portion 8, when the inner circumferential portion of the first reinforcing portion 12 is going to be pushed up, deformation of the second reinforcing portion 13 toward the outer circumferential side is blocked by the third reinforcing portion 14, which is the first restricting portion, and the second restricting portions 17 of the deformation restriction portion 16, thereby preventing the first reinforcing portion 12 from being pushed up.

Accordingly, even if an external force causing the inner circumferential portion of the exterior cover 3 to be bent back is exerted thereon and thus the inner circumferential portion of the first reinforcing portion 12 of the reinforcement member 11 is going to be pushed up due to the external force, the second and third reinforcing portions 13, 14 and the deformation restriction portion 16 blocks the inner circumferential portion of the first reinforcing portion 12 from being pushed up, thereby reliably preventing the exterior cover 3 from being bent back.

Further, when a shock is exerted on the exterior cover 3 from above, the exterior cover 3 can be elastically deformed to absorb the shock and also the shock releasing portion 15 of the reinforcement member 11 can disperse and release the shock to the inner and outer circumferential sides of the exterior cover 3. Also at this time, deformation of the second reinforcing portion 13 toward the outer circumferential side can be reliably blocked by the defamation restriction portion 16, thereby ensuring that the shock releasing portion 15 can well disperse and release the shock to the inner and outer circumferential sides of the exterior cover 3. Further, when the exterior cover 3 is elastically deformed to absorb the shock, the shock can be also absorbed by the plurality of fourth biting holes 15*a* provided in the shock releasing portion 15.

As described above, the wrist timepiece case 1 includes the case main body 2 formed of a hard material; the exterior cover 3 formed of a soft synthetic resin and mounted on the upper portion and the outer circumferential portion of the case main body 2 to cover them; and the reinforcement member 11 formed of a hard synthetic resin and embedded in the inner surface of the exterior cover 3 to prevent the inner circumferential side of the exterior cover 3 from being bent back relative to the case main body 2. Accordingly, it is possible to reliably prevent the exterior cover 3 from being bent back relative to the case main body 2 without using additional components, such as a pressing member, thereby ensuring that the exterior cover 3 can be well attached to the case main body 2.

That is, in the wrist timepiece case 1, the reinforcement member 11 is formed of a hard synthetic resin, such as polyamide or polycarbonate, having a higher rigidity, and is embedded in the inner surface of the exterior cover 3. Accordingly, even if an external force causing the inner circumferential portion of the exterior cover 3 to be bent back is exerted thereon, the reinforcement member 11 can reliably prevent the inner circumferential portion of the exterior cover 3 from being bent back.

In this case, the reinforcement member 11 includes the first reinforcing portion 12 arranged on the inner circumferential portion of the exterior cover 3 and configured to correspond to the upper end portion of the second case portion 8 of the case main body 2; the second reinforcing portion 13 arranged on the inner surface of the exterior cover 3 and configured to correspond to the outer circumferential surface 8*c* of the wall portion 8*b* of the second case portion 8; and the third reinforcing portion 15 arranged on the inner surface of the outer circumferential side of the exterior cover 3 and configured to correspond to the upper surface of the base portion 8*a* of the second case portion 8 corresponding to the notch portion located on the outer circumferential side thereof. Accordingly, even if an external force causing the inner circumferential portion of the exterior cover 3 to be bent back is exerted thereon, the first to third reinforcing portions 12 to 14 of the reinforcement member 11 can reliably prevent the inner circumferential portion of the exterior cover 3 from being bent back.

That is, according to the reinforcement member 11, when an external force causing the inner circumferential portion of the exterior cover 3 to be bent back is exerted thereon, the inner circumferential portion of the first reinforcing portion 12 is going to be pushed up due to the external force, but the second reinforcing portion 13 abuts against the outer circumferential surface 8*c* of the wall portion 8*b* of the second case portion 8, thereby reliably preventing the first reinforcing portion 12 from being pushed up Also, at this time, the third reinforcing portion 14 abuts against of the upper surface of the base portion 8*a* of the second case portion 8 located on the outer circumferential side thereof, thereby inhibiting deformation of the second reinforcing portion 13 toward the outer circumferential side.

Also, the reinforcement member 11 has the shock releasing portion 15 for releasing a shock when the shock is exerted on the exterior cover 3 from above. Therefore, if the shock is exerted on the exterior cover 3 from above, the exterior cover 3 can absorb the shock by elastic deformation thereof and also the shock releasing portion 15 can disperse and release the shock from the above toward the inner and outer circumferential sides of the exterior cover 3. As a result, it is possible to efficiently and satisfactorily absorb the shock from the outside.

In this case, the reinforcement member 11 has the deformation restriction portion 16 for restricting deformation of the first to third reinforcing portions 12 to 14 and the shock releasing portion 15. Therefore, when an external force causing the inner circumferential portion of the exterior cover 3 to be bent back is exerted thereon or when a shock is exerted on the exterior cover 3 from above, deformation of the first to third reinforcing portions 12 to 14 and the shock releasing portion 15 can be reliably prevented by the deformation restriction portion 16.

That is, the defamation restriction portion 16 includes the third reinforcing portion 15, which is the first restricting portion, arranged on the inner surface of the exterior cover 3 located on the outer circumferential portion side thereof and configured to correspond to the upper surface of the base portion 8*a* of the second case portion 8 corresponding to the notch portion located on the outer circumferential side thereof, and the second restricting portions 17 bridged between the second reinforcing portion 13 and the third reinforcing portion 14, which is the first restricting portion, and configured to restrict deformation of the second reinforcing portion 13 and the third reinforcing portion 14 relative to each other. Therefore, when an external force causing the inner circumferential portion of the exterior cover 3 to be bent back is exerted thereon or when a shock is exerted on the exterior cover 3 from above, deformation of the first to third reinforcing portions 12 to 14 and the shock releasing portion 15 due to the external force or the shock can be reliably prevented.

In this case, the defamation restriction portion 16 is configured such that the third reinforcing portion 14, which is the first restricting portion, is pressed against the upper surface of the base portion 8*a* of the second case portion 8 and also the second restricting portions 17 are bridged between the second reinforcing portion 13 and the third reinforcing portion 14, which is the first restricting portion. Therefore, when an external force causing the inner circumferential portion of the exterior cover 3 to be bent back is exerted thereon or when a shock is exerted on the exterior cover 3 from above, it is possible to reliably prevent the second reinforcing portion 13 from being deformed toward the outer circumferential side due to the external force or the shock, thereby preventing a bending deformation of the shock releasing portion 15.

Further, the reinforcement member 11 has the first to fourth biting holes 12*a* to 15*a* allowing the exterior cover 3 to bite and be fixed thereto. Therefore, when the reinforcement member 11 is embedded in the exterior cover 3, the exterior cover 3 can bite into the first to fourth biting holes 12*a* to 15*a*, thereby reliably and firmly fixing the reinforcement member 11 to the exterior cover 3.

Therefore, according to the reinforcement member 11, the exterior cover 3 can be firmly fixed to the first reinforcing portion 12, thereby reliably preventing the exterior cover 3 from being bent back even if an external force causing the inner circumferential portion of the exterior cover 3 to be bent back is exerted thereon. Also, when a shock is exerted on the exterior cover 3 from above, the shock can not only be absorbed by the exterior cover 3 but also be absorbed by the first to fourth biting holes 12*a* to 15*a*.

Further, according to the wrist timepiece case 1, the edge portion of the inner circumferential side of the first reinforcing portion 12 of the reinforcement member 11 is exposed to the outside of the inner circumferential side of the exterior cover 3, so that the edge portion of the inner circumferential side of the first reinforcing portion 12 can be visible from the outside of the exterior cover 3, thereby enhancing designability. That is, by forming the reinforcement member 11 and the exterior cover 3 to have different colors from each other, exposure of the edge portion of the inner circumferential portion of the first reinforcing portion 12 to the outside of the exterior cover 3 can become an accent on design, thereby enhancing designability.

Second Embodiment

Next, a second embodiment, in which the present invention is applied to a wrist timepiece, will be described with reference to FIGS. 6 to 9A and 9B. Meanwhile, the same parts as those of the first embodiment shown in FIGS. 1 to 5A and 5B are designated by the same reference numerals.

This wrist timepiece has substantially the same structure as that of the first embodiment, except that as shown in FIGS. 6 to 9A and 9B, a deformation restriction portion 21 of a reinforcement member 20 of a wrist timepiece case 1 thereof has a structure different from that of the first embodiment.

That is, like the first embodiment, the reinforcement member 20 is integrally formed with an exterior cover 3 using a synthetic resin, such as polyamide or polycarbonate, having a higher rigidity. As shown in FIGS. 6 to 9A and 9B, the reinforcement member 20 has first to third reinforcing portions 12 to 14, a shock releasing portion 15, and decorative portions 18. Also, the deformation restriction portion 21 for restricting deformation of the first to third reinforcing portions 12 to 14 and the shock releasing portion 15 is integrally formed with the reinforcement member 20.

As shown in FIGS. 7 to 9A and 9B, the defamation restriction portion 21 includes the third reinforcing portion 14, which is a first restricting portion, and a plurality of second restricting portions 22. Like the first embodiment, the third reinforcing portion 14, which is the first restricting portion, is a lower horizontal plate portion and is arranged on the lower surface of the exterior cover 3, which is located on the outer circumferential side thereof. Therefore, the third reinforcing portion 14 is configured to correspond to an upper surface of a base portion 8*a* of a second case portion 8 of a case main body 2, which is located on a notch portion provided on an outer circumferential side of a wall portion 8*b* thereof.

As shown in FIGS. 7 to 9A and 9B, like the first embodiment, the third reinforcing portion 14, which is the first restricting portion, is integrally formed with the second reinforcing portion 13 to extend from a lower end portion of the second reinforcing portion 13 to an outer circumferential end portion of the base portion 8*a* of the second case portion 8, which is located on the notch portion provided on the outer circumferential side of the wall portion 8*b* thereof. The third reinforcing portion 14, which is the first restricting portion, is provide with a plurality of third circular biting holes 14*a* arranged at predetermined intervals along the radial direction and configured to allow the exterior cover 3 to bite and be fixed thereto.

Figure 8:
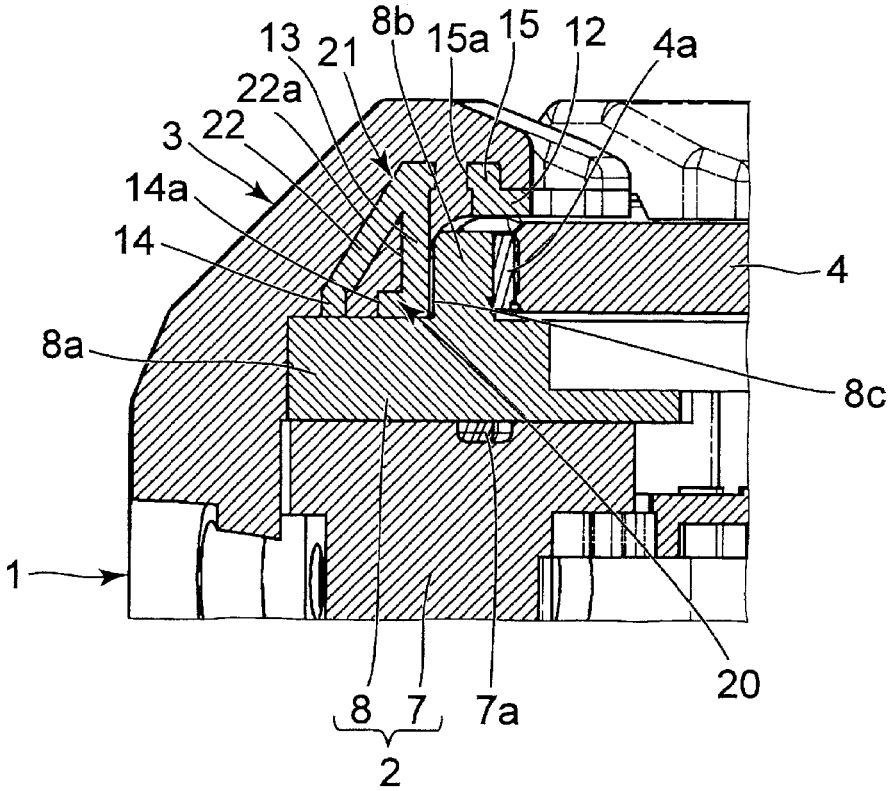
FIG. 8 is an enlarged sectional view showing the main part of the wrist timepiece case shown in FIG. 6 as viewed in a direction of a D-D arrow.
Figure 9A:
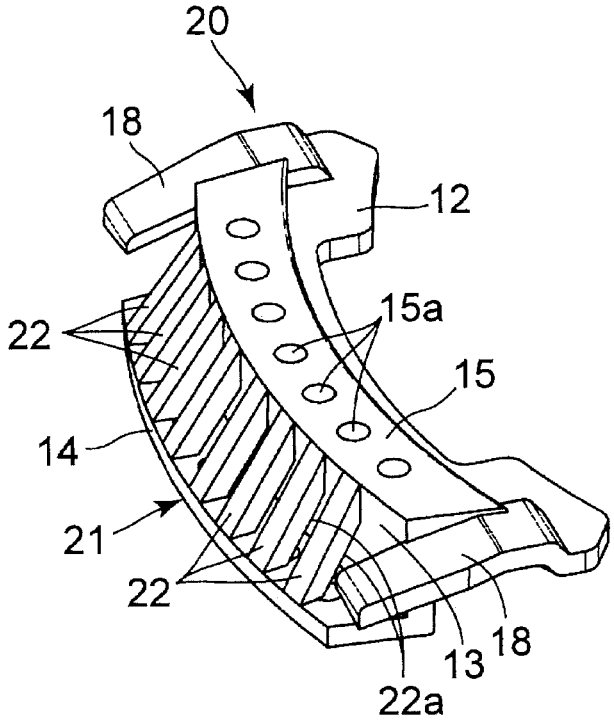
FIG. 9A is an enlarged perspective view showing a reinforcement member of the wrist timepiece case shown in FIG. 7 as viewed from above.
Figure 9B:
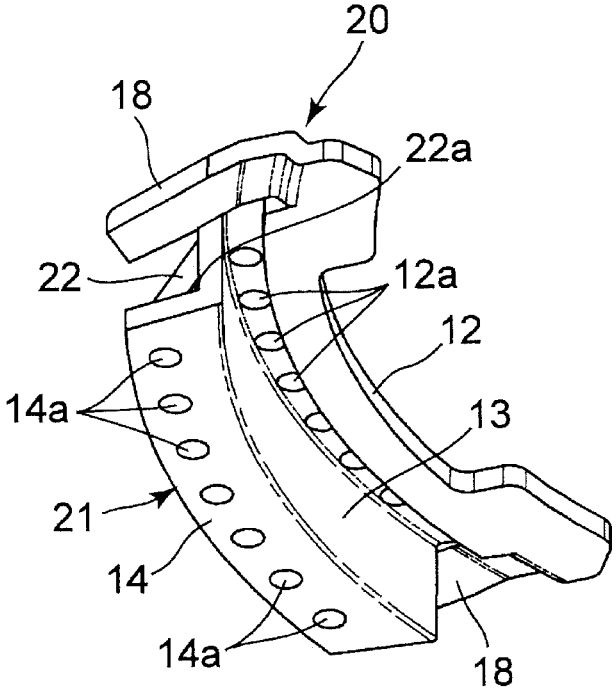
FIG. 9B is an enlarged perspective view showing the reinforcement member of the wrist timepiece case shown in FIG. 7 as viewed from below.

As shown in FIGS. 8, 9A and 9B, the plurality of second restricting portions 22 are square-rod-shaped beam portions bridged between an outer circumferential surface of the second reinforcing portion 13 and an upper surface of the third reinforcing portion 14, which is the first restricting portion, and are provided between the second reinforcing portion 13 and the third reinforcing portion 14 at equal intervals along the radial direction (length direction). Therefore, in the third reinforcing portion 14, which is the first restricting portion, a plurality of third biting holes 14*a* are provided to be positioned between the plurality of second restricting portions 22.

Also, as shown in FIGS. 8, 9A and 9B, second triangular biting holes 22*a* are provided between a corner, which is located between the second reinforcing portion 13 and the third reinforcing portion 14, which is the first restricting portion, and the plurality of second restricting portions 22 corresponding thereto. Further, since the plurality of second restricting portions 22 are provided at predetermined intervals in the second reinforcing portion 13, no biting hole is provided in the second reinforcing portion 13.

Figure 6:
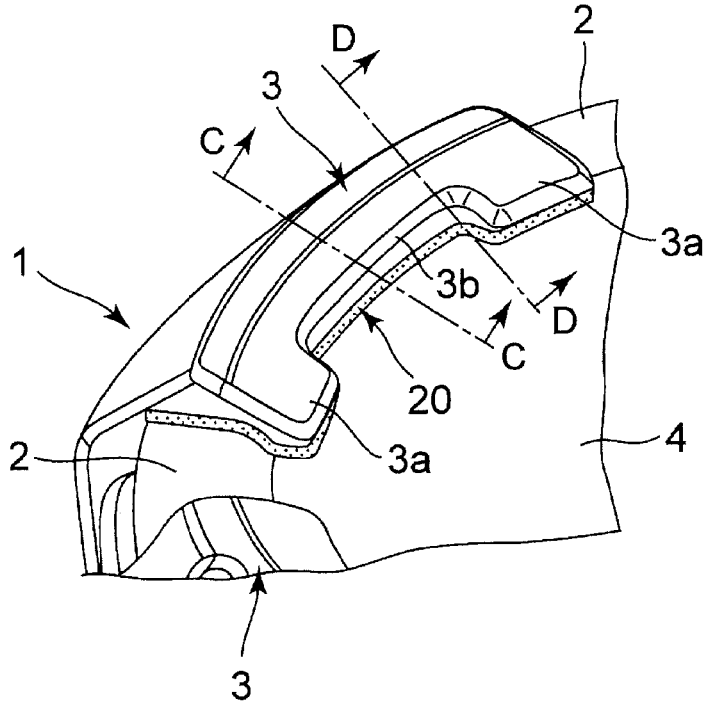
FIG. 6 is an enlarged perspective view showing a main part of a 9 o'clock side of a wrist timepiece according to a second embodiment in which the present invention is applied to a wrist timepiece.
Figure 7:
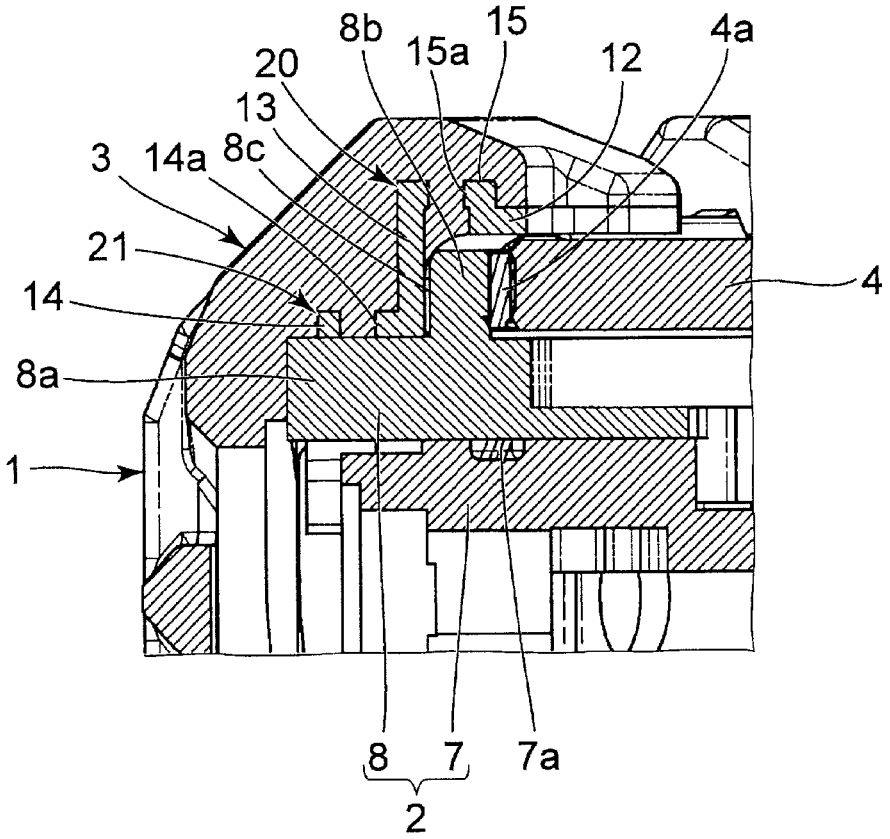
FIG. 7 is an enlarged sectional view showing a main part of a wrist timepiece case shown in FIG. 6 as viewed in a direction of a C-C arrow.

Also in the case, as shown in FIG. 6, the reinforcement member 20 is preferably formed to have a color different from that of the exterior cover 3. Thus, like the first embodiment, edge portions of the inner circumferential portion of the first reinforcing portion 12 and also of both side portions of the decorative portions 18 are exposed to the outside of the exterior cover 3 with a color different from that of the exterior cover 3. As a result, the reinforcement member 20 is configured to become an accent on design.

Next, the effects of the wrist timepiece case 1 will be described.

The exterior cover 3 and the reinforcement member 20 of the wrist timepiece case 1 are integrally formed with each other by two-color molding. Therefore, when the exterior cover 3 and the reinforcement member 11 are formed by two-color molding, the reinforcement member 11 is first molded by a first mold like the first embodiment.

In this case, a slide core for forming the second triangular biting holes 22*a* between the corner, which is located between the second reinforcing portion 13 and the third reinforcing portion 14, which is the first restricting portion, and the plurality of second restricting portions 22 corresponding thereto is arranged in a lower die of the first mold. Also, the reinforcement member 20 is formed by upper and lower dies of the first mold, and then only the upper die is separated and removed with the molded reinforcement member 20 and the slide core left in the lower die.

Thereafter, like the first embodiment, an upper die of a second mold is superimposed on the lower die of the first mold, in which the reinforcement member 20 is left, and in this state, the exterior cover 3 is molded. Then, in the state where the molded reinforcement member 20 and the slide core are left in the lower die of the first mold, the upper die of the second mold is separated therefrom. In this state, the slide core provided in the lower die of the first mold is slid and withdrawn therefrom, thereby allowing the molded reinforcement member 20 to be demolded from the lower die of the first mold.

Thus, the reinforcement member 20 having the second triangular biting holes 22*a* formed between the corner of the reinforcement member 20, which is located between the second reinforcing portion 13 and the third reinforcing portion 14, which is the first restricting portion, and the plurality of second restricting portions 22 corresponding thereto is embedded in the inner circumferential surface of the exterior cover 3, and in this state the reinforcement member 20 and the exterior cover 3 are integrally formed with each other. At this time, the exterior cover 3 is formed to bite into the first to fourth biting holes 12*a*, 22*a*, 14*a*, 15*a* provided in the reinforcement member 20.

When the exterior cover 3 with the reinforcement member 20 integrally formed as described above is attached to the case main body 2, the exterior cover 3 is mounted on a region extending from the upper portion and the outer circumferential portion of the second case portion 8 of the case main body 2 to the outer circumferential portion of the first case portion 7 like the first embodiment. In this state, the parts of the exterior cover 3 located on both side portions of each of the band attaching portions 5 are attached to the second case portion 8 by the plurality of screws 10. As a result, the wrist timepiece case 1 is assembled.

Like the first embodiment, according to the wrist timepiece case 1 as described above, the first reinforcing portion 12 of the reinforcement member 20 embedded in the exterior cover 3 is arranged to correspond to the upper end portion of the wall portion 8*b* of the second case portion 8, and the second reinforcing portion 13 is arranged to correspond to the outer circumferential surface of the wall portion 8*b* of the second case portion 8. Also, the third reinforcing portion 14, which also serves as the first restricting portion of the defamation restriction portion 21, is arranged to correspond to the upper surface of the base portion 8*a* of the second case portion 8, which is located on the outer circumferential side of the wall portion 8*b* thereof.

At this time, the edge portions of the inner circumferential portion of the first reinforcing portion 12 and also of both side portions of the decorative portions 18 in the reinforcement member 20 are arranged to be exposed to the outside of the exterior cover 3. Therefore, by forming the reinforcement member 20 to have a color different from that of the exterior cover 3, the edge portions of the inner circumferential portion of the first reinforcing portion 12 and also of both side portions of the decorative portions 18 are exposed to the outside of the exterior cover 3 with a color different from that of the exterior cover 3. Thus, the reinforcement member 20 becomes an accent on design, thereby enhancing designability.

In this state, when an external force causing the inner circumferential portion of the exterior cover 3 of the wrist timepiece case 1 to be bent back is exerted thereon, like the first embodiment, the reinforcement member 20 prevents the inner circumferential portion of the exterior cover 3 from being bent back, since the reinforcement member 20 is integrally formed with the exterior cover 3 using a synthetic resin, such as polyamide or polycarbonate, having a higher rigidity and also the exterior cover 3 bites and is fixed to the first to fourth biting holes 12*a*, 22*a*, 14*a*, 15*a* provided in the reinforcement member 20.

That is, if an external force causing the inner circumferential portion of the exterior cover 3 to be bent back is exerted thereon, like the first embodiment, the inner circumferential portion of the first reinforcing portion 12 of the reinforcement member 20 is going to be pushed up due to the external force, but the second reinforcing portion 13 abuts against the outer circumferential surface 8*c* of the wall portion 8*b* of the second case portion 8 so that the first reinforcing portion 12 is prevented from being pushed up. Therefore, the inner circumferential portion of the exterior cover 3 is not bent back.

Also, at this time, deformation of the first reinforcing portion 12 and the second reinforcing portion 13 can be prevented by the deformation restriction portion 21. That is, in the defamation restriction portion 21, the third reinforcing portion 14, which is the first restricting portion, abuts against the upper surface of the base portion 8*a* of the second case portion 8, which is located on the notch portion on the outer circumferential side thereof, and the plurality of second restricting portions 22 are bridged between the third reinforcing portion 14, which is the first restricting portion, and the second reinforcing portion 13.

Therefore, in the state where the second reinforcing portion 13 abuts against the outer circumferential surface 8*c* of the wall portion 8*b* of the second case portion 8, when the inner circumferential portion of the first reinforcing portion 12 is going to be pushed up, deformation of the second reinforcing portion 13 toward the outer circumferential side is blocked by the third reinforcing portion 14, which is the first restricting portion, and the second restricting portions 22 of the deformation restriction portion 21, thereby preventing the first reinforcing portion 12 from being pushed up.

Accordingly, even if an external force causing the inner circumferential portion of the exterior cover 3 to be bent back is exerted thereon and thus the inner circumferential portion of the first reinforcing portion 12 of the reinforcement member 20 is going to be pushed up due to the external force, the second and third reinforcing portions 13, 14 and the deformation restriction portion 21 block the inner circumferential portion of the first reinforcing portion 12 from being pushed up, thereby reliably preventing the exterior cover 3 from being bent back.

Further, when a shock is exerted on the exterior cover 3 from above, the exterior cover 3 can be elastically deformed to absorb the shock and also the shock releasing portion 15 of the reinforcement member 20 can disperse and release the shock to the inner and outer circumferential sides of the exterior cover 3. Also at this time, deformation of the second reinforcing portion 13 toward the outer circumferential side can be reliably blocked by the defamation restriction portion 21, thereby ensuring that the shock releasing portion 15 can well disperse and release the shock to the inner and outer circumferential sides of the exterior cover 3. Further, when the exterior cover 3 is elastically deformed to absorb the shock, the shock can be also absorbed by the plurality of fourth biting holes 15*a* provided in the shock releasing portion 15.

As described above, the wrist timepiece case 1 includes the case main body 2 formed of a hard material; the exterior cover 3 formed of a soft synthetic resin and mounted on the upper portion and the outer circumferential portion of the case main body 2 to cover them; and the reinforcement member 20 formed of a hard synthetic resin and embedded in the inner surface of the exterior cover 3 to prevent the exterior cover 3 from being bent back relative to the case main body 2. Accordingly, like the first embodiment, it is possible to reliably prevent the exterior cover 3 from being bent back relative to the case main body 2 without using additional components, such as a pressing member, thereby ensuring that the exterior cover 3 can be well attached to the case main body 2.

That is, according to the wrist timepiece case 1, like the first embodiment, the reinforcement member 20 is also formed of a hard synthetic resin, such as polyamide or polycarbonate, having a higher rigidity, and is embedded in the inner surface of the exterior cover 3. Accordingly, even if an external force causing the inner circumferential portion of the exterior cover 3 to be bent back is exerted thereon, the reinforcement member 20 can reliably prevent the inner circumferential portion of the exterior cover 3 from being bent back.

Also in this case, the reinforcement member 20 includes the first reinforcing portion 12 arranged on the inner circumferential portion of the exterior cover 3 and configured to correspond to the upper end portion of the second case portion 8 of the case main body 2; the second reinforcing portion 13 arranged on the inner surface of the exterior cover 3 and configured to correspond to the outer circumferential surface 8*c* of the wall portion 8*b* of the second case portion 8; and the third reinforcing portion 15 arranged on the inner surface of the outer circumferential side of the exterior cover 3 and configured to correspond to the upper surface of the base portion 8*a* of the second case portion 8 corresponding to the notch portion located on the outer circumferential side thereof. Accordingly, even if an external force causing the inner circumferential portion of the exterior cover 3 to be bent back is exerted thereon, the first to third reinforcing portions 12 to 14 of the reinforcement member 20 can reliably prevent the inner circumferential portion of the exterior cover 3 from being bent back.

In this case, the reinforcement member 20 has the deformation restriction portion 21 for restricting deformation of the first to third reinforcing portions 12 to 14 and the shock releasing portion 15. Therefore, when an external force causing the inner circumferential portion of the exterior cover 3 to be bent back is exerted thereon or when a shock is exerted on the exterior cover 3 from above, deformation of the first to third reinforcing portions 12 to 14 and the shock releasing portion 15 due to the external force or the shock can be reliably prevented.

That is, the defamation restriction portion 21 includes the third reinforcing portion 15, which is the first restricting portion, arranged on the outer circumferential side of the exterior cover 3 and configured to correspond to the upper surface of the base portion 8*a* of the second case portion 8 corresponding to the notch portion located on the outer circumferential side thereof; and the second restricting portions 22 bridged between the second reinforcing portion 13 and the third reinforcing portion 14, which is the first restricting portion, and configured to restrict deformation of them relative to each other. Therefore, when an external force causing the inner circumferential portion of the exterior cover 3 to be bent back is exerted thereon or when a shock is exerted on the exterior cover 3 from above, deformation of the first to third reinforcing portions 12 to 14 and the shock releasing portion 15 due to the external force or the shock can be reliably prevented.

In this case, the defamation restriction portion 21 is configured such that the third reinforcing portion 14, which is the first restricting portion, is pressed against the upper surface of the base portion 8*a* of the second case portion 8 and also the second restricting portions 22 are bridged between the second reinforcing portion 13 and the third reinforcing portion 14. Therefore, when an external force causing the inner circumferential portion of the exterior cover 3 to be bent back is exerted thereon or when a shock is exerted on the exterior cover 3 from above, it is possible to reliably prevent the second reinforcing portion 13 from being deformed toward the outer circumferential side due to the external force or the shock.

Further, the reinforcement member 20 has the first to fourth biting holes 12*a*, 22*a*, 14*a*, 15*a* allowing the exterior cover 3 to bite and be fixed thereto. Therefore, like the first embodiment, when the reinforcement member 20 is embedded in the exterior cover 3, the exterior cover 3 can bite into the first to fourth biting holes 12*a*, 22*a*, 14*a*, 15*a*. As a result, it is possible to reliably and firmly fix the reinforcement member 20 to the exterior cover 3 and thus to reliably prevent the inner circumferential portion of the exterior cover 3 to be bent back.

Meanwhile, although the case where the case main body 2 is constituted of the first case portion 7 and the second case portion 8 and the notch portion is provided on the outer circumference of the upper portion of the second case portion 8 has been described in the foregoing first and second embodiments, the present invention is not limited thereto. For example, the case main body may be formed as a single body and the notch portion may be provided on an outer circumference of an upper portion thereof.

Also, although the case where the third reinforcing portion 14, which also serves as the first restricting portion of the deformation restriction portion 16, 21, directly abuts against the upper surface of the base portion 8*a* of the second case portion 8 has been described in the foregoing first and second embodiments, the present invention is not limited thereto. For example, the third reinforcing portion 14, which also serves as the first restricting portion, may be embedded in the exterior cover 3 in such a manner that a part of the exterior cover 3 is arranged between the third reinforcing portion, 14 which also serves as the first restricting portion, and the upper surface of the base portion 8*a* of the second case portion 8.

Further, although the case where the present invention is applied to the wrist timepiece has been described in the foregoing first and second embodiments, the present invention is not necessarily limited to the wrist timepiece, but may be applied to various timepieces, such as travel timepieces, alarm clocks, table clocks and wall clocks. Further, the present invention is not necessarily limited to timepieces, but may be applied to electronic devices, such as mobile phones and mobile information terminals.

Although several embodiments of the present invention have been described above, the present invention is not limited thereto, but is intended to encompass the inventions as set forth in the claims and the scope equivalent thereto.

What is claimed is:

1. A case comprising:

a case main body;

an exterior cover formed of a synthetic resin and mounted on an upper portion and an outer circumferential portion of the case main body to cover the upper portion and the outer circumferential portion; and a reinforcement member formed of a synthetic resin harder than the exterior cover and embedded in an inner surface of the exterior cover to prevent an inner circumferential side of the exterior cover from being bent back relative to the case main body, wherein the reinforcement member comprises:

a first reinforcing portion configured to correspond to an upper end portion of the case main body;

a second reinforcing portion configured to correspond to an outer circumferential surface of the upper end portion of the case main body; and a third reinforcing portion configured to correspond to a notch portion provided on an outer circumference of an upper portion of the case main body.

2. The case according to claim 1, wherein the reinforcement member comprises a shock releasing portion configured to release a shock when the shock is exerted on the exterior cover from above.

3. The case according to claim 1, wherein the reinforcement member comprises:

a shock releasing portion configured to release a shock when the shock is exerted on the first reinforcing portion, the second reinforcing portion and the exterior cover from above; and a deformation restriction portion configured to restrict deformation of the shock releasing portion.

4. The case according to claim 3, wherein the deformation restriction portion comprises:

a first restricting portion arranged on the inner surface of the exterior cover located on an outer circumferential portion side thereof and configured to correspond to an upper surface of the notch portion provided on the outer circumference of the upper portion of the case main body; and a plurality of second restricting portions bridged between the second reinforcing portion and the first restricting portion and configured to restrict deformation of the second reinforcing portion and the first restricting portion relative to each other.

5. The case according to claim 1, wherein the reinforcement member comprises a plurality of biting holes allowing the exterior cover to bite and be fixed thereto.

6. The case according to claim 2, wherein the reinforcement member comprises a plurality of biting holes allowing the exterior cover to bite and be fixed thereto.

7. The case according to claim 3, wherein the reinforcement member comprises a plurality of biting holes allowing the exterior cover to bite and be fixed thereto.

8. The case according to claim 4, wherein the reinforcement member comprises a plurality of biting holes allowing the exterior cover to bite and be fixed thereto.

9. The case according to claim 1, wherein the reinforcement member is configured such that at least an edge portion of an inner circumferential side of the first reinforcing portion is exposed to an outside of the inner circumferential side of the exterior cover.

10. The case according to claim 3, wherein the reinforcement member is configured such that at least an edge portion of an inner circumferential side of the first reinforcing portion is exposed to an outside of the inner circumferential side of the exterior cover.

11. The case according to claim 4, wherein the reinforcement member is configured such that at least an edge portion of an inner circumferential side of the first reinforcing portion is exposed to an outside of the inner circumferential side of the exterior cover.

12. A timepiece comprising the case according to claim 1.

13. A timepiece comprising the case according to claim 2.

14. A timepiece comprising the case according to claim 3.

15. A timepiece comprising the case according to claim 5.

* * * * *